United States Patent [19]

Muller

[11] Patent Number: 4,618,054

[45] Date of Patent: Oct. 21, 1986

[54] EQUIPMENT FOR FEEDING PACKAGING BLANKS TO A PACKAGING MACHINE

[75] Inventor: Rolf Muller, Konz, Fed. Rep. of Germany

[73] Assignee: The Mead Corporation, Dayton, Ohio

[21] Appl. No.: 675,503

[22] Filed: Nov. 28, 1984

[30] Foreign Application Priority Data

Nov. 28, 1983 [GB] United Kingdom ..... 8331710

[51] Int. Cl.[4] ..... B65H 1/00

[52] U.S. Cl. ..... 198/409; 198/468.6; 271/157; 414/43

[58] Field of Search ..... 198/409, 486, 468.6; 414/786, 33, 53, 112, 330, 907, 43; 271/85, 157

[56] References Cited

U.S. PATENT DOCUMENTS 2,146,617 2/1939 Bishop ..... 198/409
3,967,739 7/1976 Kumagai ..... 414/33
4,049,260 9/1977 Syzmborski ..... 414/112 X
4,114,351 9/1978 Morimoto et al. ..... 198/409 X
4,395,177 7/1983 Seragnoli ..... 198/409 X

*Primary Examiner*—Robert J. Spar
*Assistant Examiner*—Janice Krizek
*Attorney, Agent, or Firm*—Erwin Doerr

[57] ABSTRACT

Equipment for continuously feeding a supply of packaging blanks to a packaging machine comprises a feed magazine (10) for holding and sequentially feeding a series of stacks (S1–S5) of packaging blanks, a feed hopper (14) to receive at least one stack of blanks at a time from the feed magazine and present the blanks for use in the machine and a transfer mechanism (12) for transferring a stack of blanks from the feed magazine to the feed hopper. A sensor (66) is provided automatically to actuate the transfer mechanism when the supply of blanks held by the feed hopper reaches a predetermined level and a switch (70) is provided automatically to advance the series of stacks in the feed magazine so that the next succeeding stack is positioned for transfer to the feed hopper.

4 Claims, 3 Drawing Figures

EQUIPMENT FOR FEEDING PACKAGING BLANKS TO A PACKAGING MACHINE

This invention relates to equipment and method for continuously feeding a supply of packaging blanks to a packaging machine.

One aspect of the invention provides equipment for continuously feeding a supply of packaging blanks to a packaging machine which equipment comprises a feed magazine for holding and sequentially feeding a series of stacks of packaging blanks, a feed hopper to receive at least one stack of blanks at a time from the feed magazine and present the blanks for use in the machine and a transfer mechanism for transferring a stack of blanks from the feed magazine to the feed hopper, means being provided automatically to actuate said transfer mechanism when the supply of blanks held by the feed hopper reaches a predetermined level so that a further supply of blanks is transferred from the feed magazine to replenish the feed hopper.

Preferably, the feed magazine holds a linear series of stacked blanks in which the blanks in each stack are vertically layered and the transfer mechanism turns each stack during transfer from the feed magazine to the feed hopper so that the transferred stack is positioned in the feed hopper on its end and in an inclined attitude.

Another aspect of the invention provides a method of continuously feeding a supply of packaging blanks to a packaging machine which method comprises automatically actuating a transfer mechanism in response to sensing means indicating that blanks held in a feed hopper of the machine have reached a predetermined level so that the transfer mechanism collects a supply of blanks from a feed magazine, causing the transfer mechanism to transfer said supply of blanks from the feed magazine to replenish said feed hopper and actuating the feed magazine to position a further supply of blanks for transfer when the transfer mechanism is next actuated.

Figure 1:
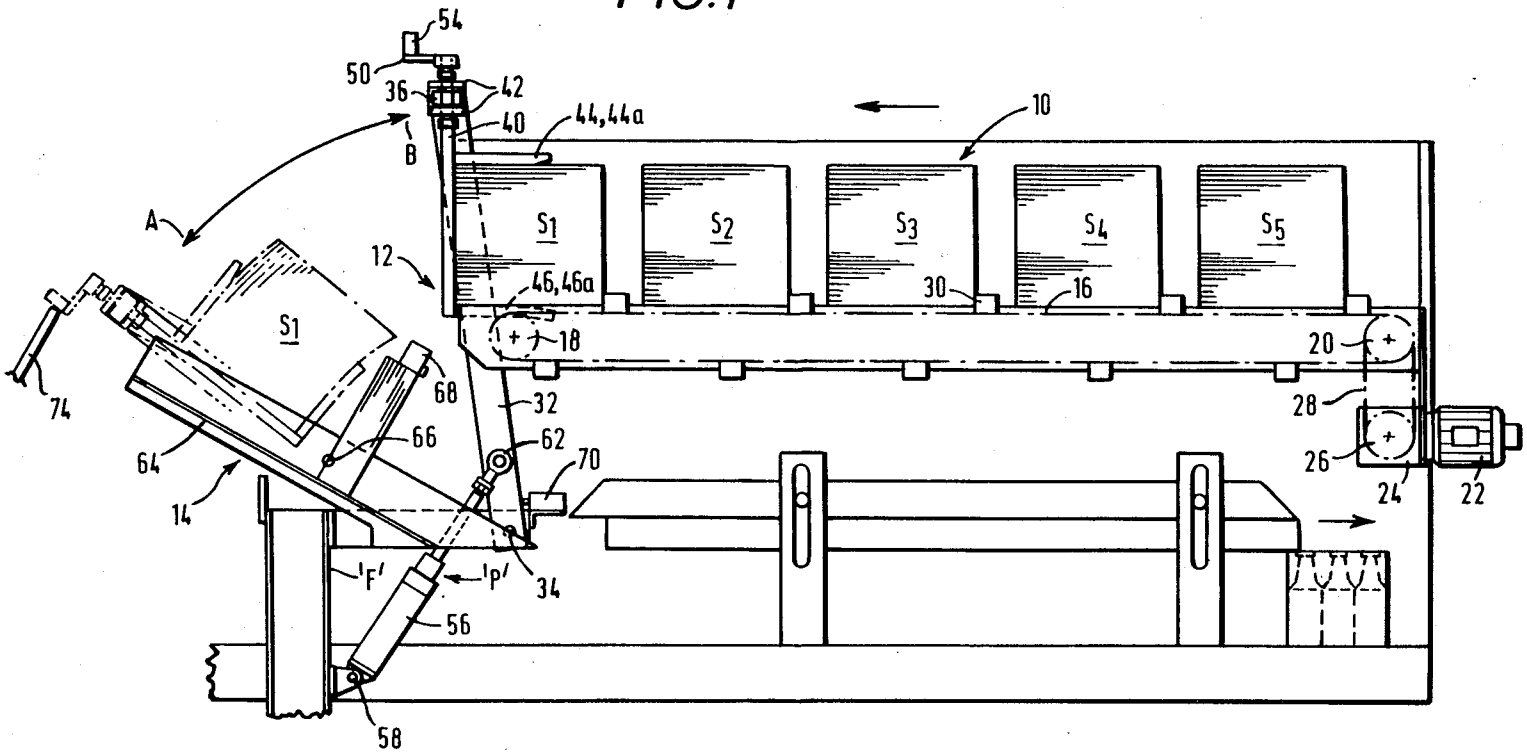
Figure 2:
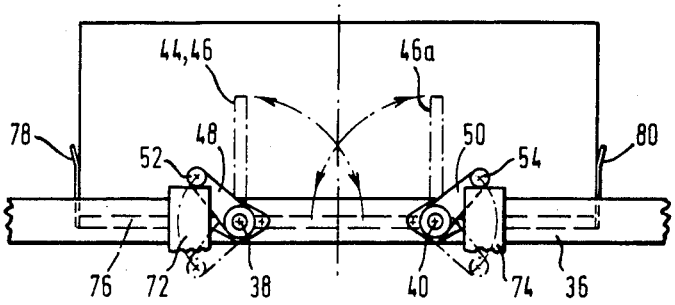
Figure 3:
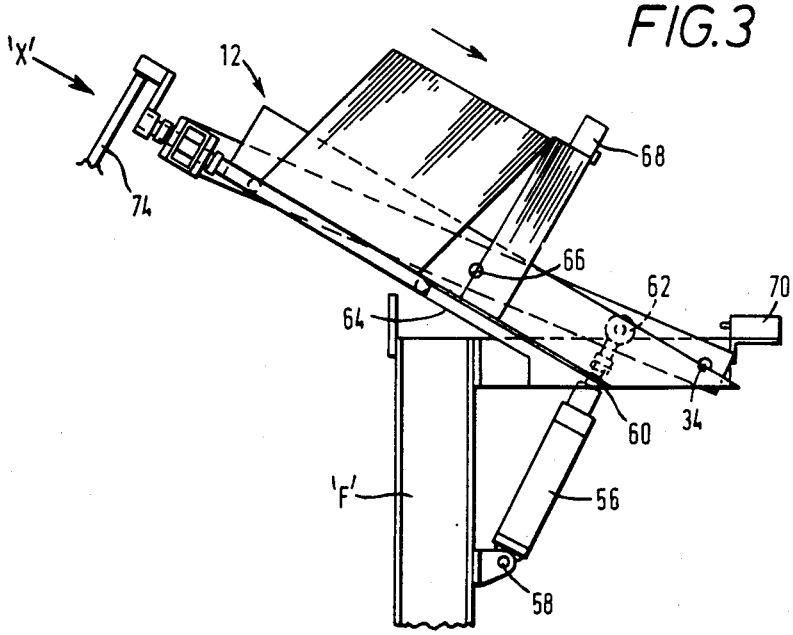

An embodiment of the invention will now be described, by way of example, with reference to the accompanying drawings, in which:

FIG. 1 is a schematic side view of equipment for continuously feeding a supply of blanks to a packaging machine, FIG. 3 is a schematic side view of a feed hopper and transfer mechanism of the equipment with the transfer mechanism shown at the completion of a transfer operation, and FIG. 2 is a schematic view of a part of the transfer mechanism taken in the direction of arrow 'X' in FIG. 3.

Referring now to the drawings, the blank supply equipment for continuously feeding a supply of blanks to a packaging machine comprises three main devices; a feed magazine 10 which holds and intermittently feeds a linear series of stacked blanks; a transfer mechanism 12 which transfers each stack of blanks into a feed hopper and the feed hopper 14 which is mounted at the infeed end of a packaging machine.

In FIG. 1 there is shown the feed magazine 10 which comprises a pair of spaced parallel endless chains 16 entrained about sprockets 18 and 20 respectively. The chains are driven intermittently by a step-motor 22 via gear box 24, and drive sprocket and chain 26,28, respectively. The chains are interconnected by a series of transverse drive bars 30 mounted at spaced locations along the length of the chains. When the feed magazine 10 is loaded a series of stacked blanks 'S1–S5' are accomodated on the uppermost run of the chains such that each stack is located between an adjacent pair of drive bars. As shown (FIG. 1) the blanks are stacked vertically in the feed magazine and each stack is pushed forwardly (from right to left) by engagement of a drive bar at the rear of a stack.

The blank transfer mechanism 12 is mounted at the forward end of the feed magazine and transfers the leading stack ('S1') of blanks from the feed magazine to the feed hopper 14 of the machine.

The transfer mechanism 12 comprises an elongate pivotal arm 32 which is pivotally mounted to the frame 'F' of the machine by pivot pin 34.

A cross member 36 is fixed to the free upper end of pivotal arm 32 from which depends a pair of spaced rotatable shafts 38, 40 respectively. The shafts 38 and 40 are journalled in bearings 42 and each shaft carries a pair of outwardly projecting blank support arms comprising upper arm **44, 44*a* and lower arm 46, 46*a*. The arms are spaced apart so as to engage the upper and lower blanks of the leading stack S1 when the transfer mechanism is in the position shown in solid lines in FIG. 1. The end of each shaft 38 and 40 adjacent the cross member 36 carries a lever arm 48,50 which terminates in cam followers 52 and 54**, respectively.

The pivotal arm 32 is actuated by a pneumatic piston and cylinder mechanism 'P' comprising a cylinder 56 pivotally mounted to the machine frame 'F' at pivot pin 58 and piston rod 60 pivotally mounted intermediate the ends of arm 32 by pivot pin 62.

The feed hopper 14 of the machine comprises an inclined platform or chute 64 positioned to receive a stack of blanks from the transfer mechanism and which is attached to, or integral with, the machine frame 'F'. A photoelectric switch 66 is provided intermediate the ends of the feed hopper. A forward stop 68 is provided adjacent the supply end of the feed hopper to arrest the leading blank until it is withdrawn to be fed into the packaging machine by suitable means such as suction cups (not shown). A limitswitch 70 is mounted on machine frame 'F' adjacent the pivotal end of pivot arm 32.

In operation, when the supply of blanks within the feed hopper 14 is reduced so that the trailing blank clears the photoelectric switch 66, the piston and cylinder mechanism 'P' is activated so that the piston rod 60 is extended from the position shown in FIG. 3. Thus, the pivot arm 32 is caused to rotate in the direction of arrow 'B' (FIG. 1). The pivotal arm abuts switch 70 and the step-motor 22 is activated to drive the feed magazine chains whereby the series of stacked blanks is advanced. As pivot arm reaches its uppermost position, the leading stack of blanks 'S1' is received between the sets of blank support arms 44,46 and **44*a*,46*a***.

The feed magazine chains continue to be driven so that the leading stack of blanks 'S1' push against rotatable shafts 38 and 40 thereby causing the loaded transfer mechanism to pivot in the direction of arrow 'A' (FIG. 1). When the limitswitch is disengaged by the pivotal arm, the piston and cylinder mechanism 'P' is again activated so that piston rod 60 is retracted in order to further continue the downward pivotal movement of the transfer mechanism carrying stack 'S1'. Simultaneously, the power to step-motor is interrupted to halt the advance of the next succeeding stack of blanks 'S2'.

Immediately before the transfer mechanism pivots into its lowermost position, each of the cam followers 52 and 54, carried by lever arms 48 and 50, strike against fixed cam elements 72 and 74 respectively which are mounted on the packaging machine in the path of movement of the transfer mechanism. As the transfer mechanism continues to pivot downwardly the lever arms are caused to rotate through 90° (FIG. 2) thereby causing a corresponding rotation of shafts 38 and 40 so that the blank support arms also are rotated through 90°. It will be appreciated that this rotation of the blank support arms move them out of engagement with the endmost blanks in stack 'S1' so that when the transfer mechanism reaches the position shown in FIG. 3, the blanks are able to feed lengthwise down the feed hopper. The platform 64 of the feed hopper is slotted or may comprise a series of spaced apart bars so that the blanks seated on the shafts 38 and 40 will also be seated on the hopper platform when the transfer mechanism completes its downward pivotal movement. Further, in order to facilitate the forward feed of the blanks within the feed hopper, the platform may be caused to continuously vibrate by suitable means.

The lever arms 48 and 50 are resiliently loaded as by return springs (not shown) so that when the transfer mechanism is again actuated to execute its upward pivotal movement, the blank support arms automatically are returned to project forwardly so as to engage the endmost blanks in the next succeeding stack to be transferred.

As shown schematically in FIG. 2, the transfer mechanism includes a lateral support guide 76 which includes flank plates 78 and 80 to engage the sides of a stack of blanks. The plates 78 and 80 may be adjustable towards and away from one another so that the guide 76 can receive variously sized blanks.

The blank supply equipment of this invention enables a feed hopper of a packaging machine to be automatically replenished with a continuous supply of blanks which permits uninterrupted operation of the machine with minimum supervision. Moreover, the equipment is constructed and arranged so that it does not occupy an undue amount of space.

What I claim is:

1. In a packaging machine of the type having a feed hopper for holding a supply of packaging blanks, the arrangement for automatically feeding stacks of such blanks to said feed hopper comprising a feed magazine for supporting and sequentially advancing a series of stacks of packaging blanks to a transfer position adjacent said feed hopper, a transfer mechanism for transferring the leading stack of blanks from said feed magazine to said feed hopper, and means for moving the next stack of blanks to said transfer position, said transfer mechanism comprising a pivotal arm (32) mounted for reciprocal movement between said feed magazine (10) and said feed hopper (14) and including blank support means (44,46; 44*a*,46*a*) arranged for receiving and supporting said leading stack of blanks and means for releasing the same when the pivotal arm arrives at the feed hopper to deposit said stack in said feed hopper, said blank support means comprising blank support arms for engaging respectively the uppermost and lowermost blank in said leading stack to be transferred, said means for releasing said stack including means for pivoting said blank support arms out of engagement with said uppermost and lowermost blanks when the stack is positioned in said feed hopper.

2. The arrangement of claim 1, further characterised in that said feed magazine comprises a horizontally extending conveyor means for supporting a series of stacks of blanks in which the blanks are horizontally disposed, and that said transfer mechanism turns each stack during transfer from said feed magazine to said feed hopper so that the transferred stack is positioned on its end and in inclined attitude in said feed hopper.

3. The arrangement according to claim 1, further characterized in that said blank support means comprises a rotatable shaft interconnecting said blank support arms, and cam means effective to cause rotation of said blank support arms.

4. The arrangement according to claim 1, further including means for actuating said transfer mechanism when the supply of blanks held in the feed hopper reaches a predetermined level.

* * * * *